United States Patent [19]

Marshall et al.

[11] Patent Number: 4,539,504

[45] Date of Patent: Sep. 3, 1985

[54] MOTOR VEHICLE HEADLIGHT WITH IMPROVED CONTACT LUG RETENTION MEANS

[75] Inventors: Robert J. Marshall; Thu T. Le, both of Seymour, Ind.

[73] Assignee: GTE Products Corporation, Stamford, Conn.

[21] Appl. No.: 459,271

[22] Filed: Jan. 19, 1983

[51] Int. Cl.[3] ..... H01J 5/16

[52] U.S. Cl. ..... 313/113; 313/110

[58] Field of Search ..... 313/113, 110, 331, 332; 362/296, 307, 310

[56] References Cited

U.S. PATENT DOCUMENTS 4,181,869 1/1980 Warren et al. ..... 313/113

FOREIGN PATENT DOCUMENTS 2312633 9/1973 Fed. Rep. of Germany ..... 362/296

*Primary Examiner*—David K. Moore

*Attorney, Agent, or Firm*—Lawrence R. Fraley

[57] ABSTRACT

A motor vehicle headlight wherein plastic reflector and lens components are utilized and serve to house a tungsten-halogen lamp capsule therein. Forming part of the rear portion of the plastic reflector is an upstanding portion for each of the headlight's terminal means. Each upstanding portion includes a surface for having the metallic lug member of the terminal means positioned thereon and a retaining flange portion of U-shaped configuration for housing part of the lug to prevent displacement thereof relative to the location where the lug is secured to the headlight's eyelet member. Precise alignment of the lug is thus maintained during manufacture of the headlight.

8 Claims, 3 Drawing Figures

MOTOR VEHICLE HEADLIGHT WITH IMPROVED CONTACT LUG RETENTION MEANS

TECHNICAL FIELD

The present invention relates in general to headlights and particularly to those of the automotive (motor vehicle) variety. Even more particularly, the present invention relates to motor vehicle headlights wherein the reflector and lens components which comprise the headlight are of a plastic material.

BACKGROUND

Motor vehicle headlights having a plastic reflector and lens secured thereto have been recently introduced and provide several advantages over existing headlights wherein the reflector and lens components are comprised of glass. Examples are shown in U.S. Pat. Nos. 4,344,120 (Bradley et al), 4,342,142 (Nieda et al), 4,280,173 (Bradley et al), 4,210,841, (Vodicka et al) and 4,181,869 (Warren et al). One particular advantage of a plastic headlight wherein a tungsten-halogen capsule is utilized as the light source is a significant savings in weight. For example, a savings of approximately three pounds over a standard glass, four headlight system has been realized when using four corresponding plastic headlights. In addition, it has been determined that a plastic lens transmits from about ten to about fifteen percent more light than a glass lens because it is possible to mold a plastic (e.g., polycarbonate) lens with sharper (more precise) optics than is possible when molding glass. In addition to the above, plastic headlamps utilizing a tungsten-halogen capsule as the light source have been shown to save approximately five amperes of electricity when operated in the low beam mode.

During manufacture of plastic headlights of the type described above (those having a tungsten-halogen capsule), it is necessary to firmly position the capsule within the headlight relative to the reflector's internal reflecting surface. This is typically done by utilization of at least two (and sometimes three) support wires which in turn are connected to the lamp capsule, either to the lead-in wires extending from the capsule or to a suitable conductive retainer fitted over the capsule's press-sealed end. The support wires in turn penetrate the rear portion of the reflector through a corresponding plurality of openings located therein. A metallic eyelet member is often inserted within the opening and joined to a corresponding metallic lug member located externally of the reflector and designed for providing electrical connection to an external source (e.g., an electrical connector forming part of the motor vehicle's wiring system). One specific example of such an arrangement is the headlight shown and described in the aforementioned U.S. Pat. No. 4,181,869 (Warren et al), said patent assigned to the same assignee as the instant invention.

During manufacture of the above headlights, several problems have arisen with regard to proper orientation of the metallic lug member during both the aforementioned attachment to the eyelet as well as during subsequent operations such as soldering of the support wire (which passes through both eyelet and lug) to the eyelet member. Misorientation of even one of the lug members in turn prevents subsequent connection to the described connector and/or similar external means, thus resulting in a defective end product.

It is believed, therefore, that a motor vehicle headlight which provides a new and unique means for properly retaining the metallic lug component in a proper orientation during manufacture of the headlight would constitute a significant advancement in the art.

DISCLOSURE OF THE INVENTION

Accordingly, it is a primary object of the present invention to provide a motor vehicle headlight wherein improved lug member retention is made possible during the manufacture of the headlight.

To accomplish the foregoing and other objects of this invention, there is provided a motor vehicle headlight which comprises a plastic reflector having a curved rear portion and a forward open end portion, a lens secured to the reflector, an electric lamp (e.g., tungsten-halogen) disposed within the reflector and including a glass envelope, at least two lead-in wires projecting from the envelope and at least two support wires, each being fixedly secured to a respective one of the lead-in wires and each passing through respective openings within the reflector's rear portion, and terminal means for being connected electrically to at least one of the support wires. The terminal means includes a metallic eyelet located within one of the reflector's openings and a metallic lug member having a base segment and an upstanding leg segment, said eyelet being secured to the base segment of the lug. The curved rear portion of the reflector includes an upstanding portion located about the opening having the eyelet therein and having an upper surface and a retaining flange portion. The base segment of the metallic lug member is positioned on an upper surface of the upstanding portion while the retaining flange portion engages at least two opposing surfaces of the lug's upstanding leg at a spaced location from where the eyelet is secured to the lug's base segment. Tilting or rotational movement of the lug during assembly is substantially prevented.

BEST MODE FOR CARRYING OUT THE INVENTION

For a better understanding of the present invention, together with other and further objects, advantages and capabilities thereof, reference is made to the following disclosure and appended claims in connection with the above described drawings.

Figure 1:
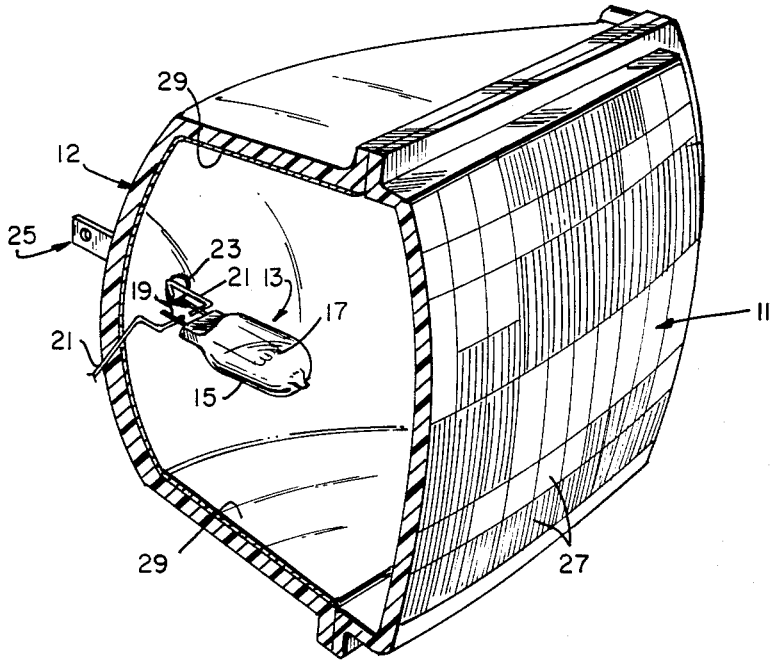
FIG. 1 is a partial perspective view of a motor vehicle headlight in accordance with one embodiment of the invention.

A motor vehicle headlight in accordance with a preferred embodiment of the instant invention is shown in FIG. 1 and comprises a plastic (e.g., polycarbonate) lens 11 bonded to the front of a curved, usually parabolic, plastic (e.g., polycarbonate) reflector 12 and in which a tungsten-halogen lamp capsule 13 is disposed. Lamp capsule 13 can be a hardglass type of tungsten-halogen lamp, as shown, for example, in U.S. Pat. No. 3,829,729 (Westlund et al). Lamps of this type typically include a glass envelope 15 having therein a specific filament structure 17 which, when energized, provides the required light output for the capsule. Lamp capsule 13 may include a singular filament or alternatively, a pair of spaced filaments should it be desirable to provide both high and low beams from a single headlight. Understandably, dual filament tungsten-halogen lamp capsules are employed in motor vehicle lighting systems wherein only two headlights are utilized, whereas single filament capsule types of headlights are employed in four lamp arrangements wherein each pair provides the low and high beams, respectively.

Projecting from the sealed end of envelope 15 is a pair of metal lead-in wires 19 which in turn are each positively connected (e.g., welded) to a corresponding, metal support wire 21. Each of the support wires passes through a corresponding opening 23 (only one shown in FIG. 1) located within the rear portion of the plastic reflector. As will be described below, each support wire is in turn connected to a terminal means to thus provide an efficient means for electrically connecting the headlight of the instant invention to the corresponding electrical circuitry of the motor vehicle in which the invention is utilized. As will also be described below, each terminal means includes at least one lug member 25 for effecting the aforementioned connection (e.g., to a connector forming part of the vehicle's electrical circuitry).

As shown in FIG. 1, lens 11 includes a plurality of individual lens elements 27 designed for directing light from lamp 13 therethrough to produce a preestablished pattern. Accordingly, it is seen that reflector 12 includes a forward open end portion through which said light passes and to which is secured the rectangular lens 11. Lens 11 thus provides a closure for the reflector's open end. An internal reflective coating 29 (e.g., aluminum) is provided on the reflector's internal surfaces to reflect light in the desired direction toward lens 11 and thus enhance output of the instant invention.

Figure 2:
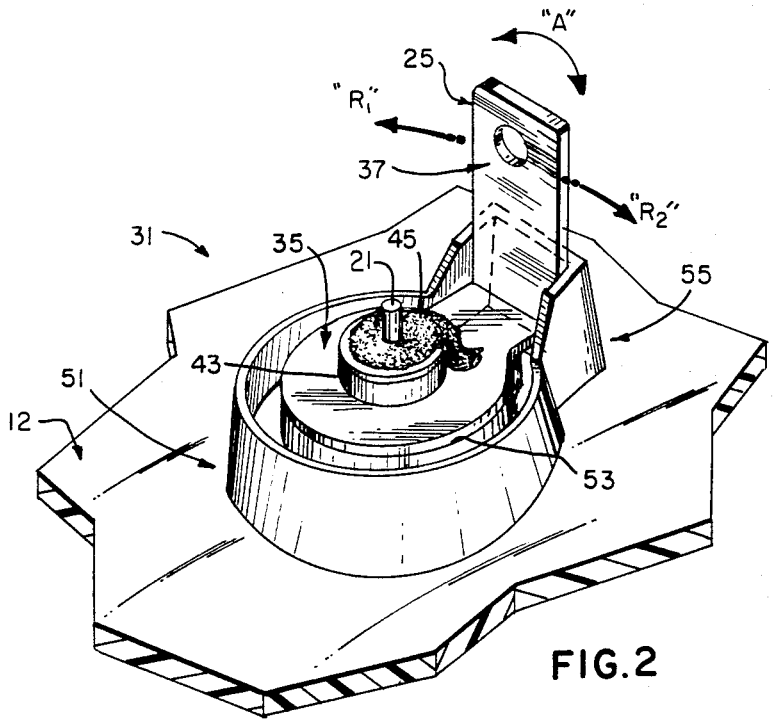
FIG. 2 is a partial perspective view of a terminal means for use with the headlight shown in FIG. 1 and illustrating a preferred embodiment for positively retaining the invention's lug member during manufacture thereof.
Figure 3:
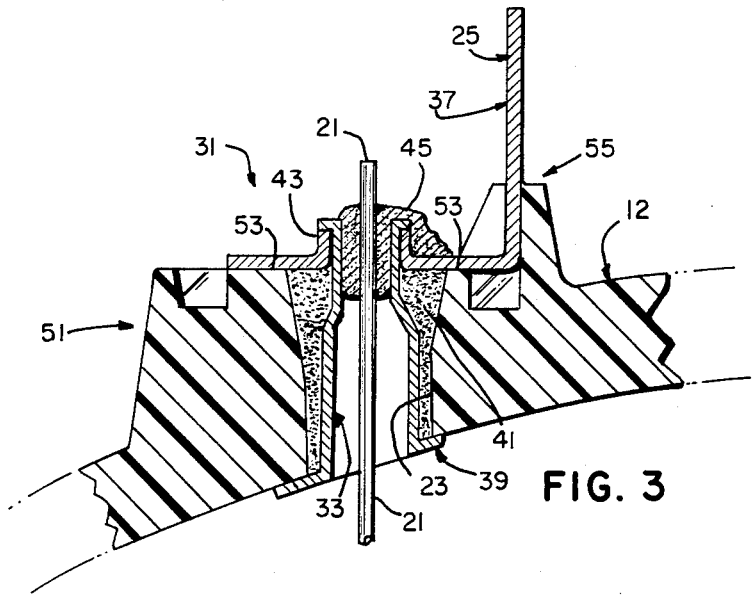
FIG. 3 is a partial side elevational view, in section, of the terminal means and reflector depicted in FIG. 2.

With particular attention to FIGS. 2 and 3, there is shown a terminal means 31 in accordance with a preferred embodiment of this invention. As stated, at least one terminal means is utilized to positively connect the support wire (which in turn is electrically connected to a respective one of the lead-in wires projecting from lamp capsule 13) to the vehicle's circuitry. It is of course understood that at least two support wires are utilized in each headlight and therefore a corresponding number of terminal means are preferably employed. It is further understood that in those headlights wherein three support wires are utilized for the lamp capsule component (dual beam variety), a corresponding number of terminal means are similarly utilized. Because these other terminal means are similar to that depicted in FIGS. 2 and 3, description other than that provided for the embodiment of the invention depicted in the drawings is not deemed necessary.

Terminal means 31 comprises a metallic (e.g., brass, aluminum, copper, steel, or nickel-iron alloy) eyelet member 33 which is positioned within the corresponding opening 23 through which support wire 21 passes. Terminal means 31 further includes a metallic (e.g., brass) lug member 25 having a base segment 35 and an upstanding leg segment 37 oriented at approximately ninety degrees to the base segment. Both segments 35 and 37 are of substantially flat configuration except for an upstanding, cylindrical shaped flange portion (43) formed in the center of the rounded end of base segment 35.

Assembly of the invention is accomplished by inserting the metallic eyelet 33 upwardly through opening 23 from the inside of reflector 12. The head 39 of the eyelet is formed at an angle to the axis of the eyelet so as to approximately conform to the reflector's internal curvature. In turn, the body of eyelet 33 can be formed of two or more diameters (as shown), the larger one being formed to maintain concentricity with opening 23 and the smaller one being formed to maintain concentricity with the support wire 21 and to provide the correct diameter for subsequent setting (riveting) of the eyelet, as will be described below. Metallic lug member 25 serves to provide electrical connection to the aforementioned external power source. The function of eyelet 33, therefore, is to maintain lug 25 securely in place and to provide a fixed point to which support wire 21 can be attached. Unfortunately, however, in many prior techniques for providing this connection, it was impossible to positively align and maintain the eyelet in the fixed orientation necessary. In addition, even with the eyelet and lug members secured in the manner described, it was readily possible for the lug to become disoriented as a result of handling of the headlamp during subsequent manufacturing steps.

During assembly, eyelet 33 is inserted upwardly as described above and a suitable adhesive 41 is applied in the annular area of opening 23 around the eyelet. Examples of suitable adhesives for use with the invention include a thermoplastic, thermoset or hot melt material. Examples of these include epoxies, epoxy-urethanes, urethanes, polyesters, acrylics, synthetic rubbers, silicone rubbers, polyamides, phenolics, acrylates, polycarbonates, polystyrenes and silicone molding powders, to name a few.

With eyelet 33 in position and the described adhesive located thereabout, lug 25 is then lowered to surround the upwardly projecting, smaller end of the eyelet. As such, this upper end of the eyelet is originally of a straight, cylindrical configuration. To accommodate this end, the base segment 35 of lug 25 includes the aforementioned upstanding annular flange portion 43 which includes an inner diameter slightly larger than the external diameter for the upper, cylindrical end of eyelet 33. With the lug in position, the uppermost end of the eyelet is spun, flattened, or peened over onto the flange 43 in the manner depicted in FIG. 3. This technique is often defined as riveting and occurs while the described adhesive remains in paste-like form. Accordingly, it can be understood how displacement of the lug, especially the leg segment 37, could occur. As a result of the above operation, the upward end portion of eyelet 33 is mechanically secured and electrically connected to the base segment 35 at a position located a spaced distance from leg segment 37.

Subsequent to the above operation, solder 45 is applied to electrically connect the upstanding support wire 21 and eyelet 33. One example of suitable solder is a 60/40 tin-lead composition, although a 20/80 tin-lead composition will also suffice. To further enhance the electrical connection at this location of the invention, excessive solder is preferably utilized to flow over and make contact with the base segment 35. This overflow is shown to the right of flange portion 43 in FIG. 3. The above operations are performed preferably for each of the above support wires utilized in the invention.

To prevent any displacement of lug 25 during the above assembly techniques, there is provided within the curved rear portion of reflector 12 an upstanding portion 51 located about and relative to each corresponding opening 23 through which one of the support wires 21 passes. Upstanding portion 51 forms an integral part of the reflector's rear portion and includes an upper, flat external surface 53 of substantially annular configuration and designed for having the rounded part of the flat base segment 35 positioned thereon in a substantially flush arrangement. As clearly shown in FIG. 3, upstanding portion 51 is that portion of the reflector which extends above the curvilinear back surface thereof. The arrowhead of the numeral 12 is located on this back surface. As shown, an annular channel is formed within the uppermost part of upstanding portion 51 to in turn define an "island" which has as its upper surface the flat surface 53 (also of substantially annular configuration) which serves to provide the surface upon which the base (bottom) segment of lug terminal 25 rests. Upstanding portion 51 represents merely an upward extension of the reflector and thus constitutes the aforementioned integral part thereof (see also the sectioning in FIG. 3). In addition, upper portion 51 includes a retaining flange portion 55 for engaging opposing sides of upstanding leg segment 37 to thus uniquely prevent any displacement thereof relative to the location where eyelet 33 and base segment 35 are crimped. As can be seen in FIG. 2, such movement would be in a pivotal direction relative to this common point which in turn could result in such displacement of the leg segment so as to render subsequent connection impossible between this leg segment and a fixed electrical connector forming part of the vehicle's electrical system. As stated, the retaining flange portion 55 engages opposite sides of leg segment 37 and is preferably of a substantially U-shaped configuration so as to house the lower part of leg 37 and mating part of base 35 therein. Lug 25 is thus firmly held in at least a three point form of retention. As has been shown and described, this means of retaining lug 25 also substantially prevents tilting of the segment relative to the pivotal location. The direction for such tilting, if possible, is represented by the arrow "A" in FIG. 2. This tilting would be toward (or directly away from) the viewer in FIG. 3, if allowed. Rotational movement also prevented by the unique seating means of the invention is depicted by the directional arrows "$R_1$" and "$R_2$" (FIG. 2).

There has thus been shown and described a new and unique means whereby positive retention of a metallic lug member is accomplished during manufacture of the motor vehicle headlight utilizing the lug in such a manner that precise alignment thereof is assured. This unique means of retention has been provided by forming an upstanding portion within the rear of the plastic reflector during formation (e.g., injection molding) thereof and thus does not constitute a significant increase in the cost of producing the reflector. As further described, the resulting member is readily adaptable for use in mass production and thus further assures reduced cost for the end product.

While there have been shown and described what are at present considered the preferred embodiments of the invention, it will be obvious to those skilled in the art that various changes and modifications may be made therein without departing from the scope of the invention as defined by the appended claims.

What is claimed is:

1. A motor vehicle headlight comprising:

a plastic reflector having a curved rear portion having at least one opening thereon, and a forward, open end portion;

a lens member secured to said open end portion of said reflector to provide a closure therefor;

an electric lamp disposed within said reflector and including a glass envelope, at least two lead-in wires projecting from said envelope, and at least two support wires, each of said wires being fixedly secured to a respective one of said lead-in wires and passing through said rear portion of said reflector; and terminal means for being electrically connected to at least one of said support wires, said terminal means comprising a metallic eyelet located within said opening within said reflector, and a metallic lug member having a base segment and an upstanding leg segment, said eyelet being secured to said base segment of said lug at a first location, said curved rear portion of said reflector including an upstanding portion located about said opening having said eyelet therein, said upstanding portion including a substantially flat upper external surface and a retaining flange portion, said base segment of said metallic lug member positioned on said flat upper external surface of said upstanding portion and said retaining flange portion engaging at least two opposing surfaces of said upstanding leg segment of said lug member at a spaced, second location from said first location where said eyelet is secured to said base segment to provide a three point form of retention for said lug member such that tilting and rotational movement of said lug member relative to said first location is substantially prevented.

2. The motor vehicle headlight according to claim 1 wherein the number of said support wires is two and the number of said terminal means is two, each of said terminal means being electrically connected to a respective one of said support wires.

3. The motor vehicle headlight according to claim 1 wherein the number of said support wires is three and the number of said terminal means is three, each of said terminal means being electrically connected to a respective one of said support wires.

4. The motor vehicle headlight according to claim 1 wherein said electric lamp is a tungsten-halogen lamp.

5. The motor vehicle headlight according to claim 1 wherein said eyelet is comprised of a metal selected from the group consisting of brass, aluminum, copper, steel and a nickel-iron alloy.

6. The motor vehicle headlight according to claim 1 wherein said lug member is comprised of brass.

7. The motor vehicle headlight according to claim 1 wherein said lens member is comprised of plastic material.

8. The motor vehicle headlight according to claim 1 wherein said retaining flange portion is of a substantially U-shaped configuration.

* * * * *